US009500426B2

(12) United States Patent
Salvador

(10) Patent No.: US 9,500,426 B2
(45) Date of Patent: Nov. 22, 2016

(54) SOUND SUPPRESSOR

(71) Applicant: FLODESIGN, INC., Wilbraham, MA (US)

(72) Inventor: Joseph D Salvador, Wilbraham, MA (US)

(73) Assignee: DAVINCI ARMS LLC, Wilbraham, MA (US)

( * ) Notice: Subject to any disclaimer, the term of this patent is extended or adjusted under 35 U.S.C. 154(b) by 0 days.

(21) Appl. No.: 14/718,246

(22) Filed: May 21, 2015

(65) Prior Publication Data

US 2015/0338183 A1 Nov. 26, 2015

Related U.S. Application Data

(60) Provisional application No. 62/001,320, filed on May 21, 2014.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 3,385,164 | A * | 5/1968 | Hubner | F41A 21/30 181/223 |
| 4,588,043 | A * | 5/1986 | Finn | F41A 21/30 181/223 |
| 5,164,535 | A * | 11/1992 | Leasure | F41A 21/30 181/223 |
| 7,237,467 | B1 * | 7/2007 | Melton | F41A 21/30 89/14.4 |
| 7,308,967 | B1 * | 12/2007 | Hoel | F41A 21/30 181/223 |
| 8,167,084 | B1 | 5/2012 | Moore | |
| 8,973,481 | B2 | 3/2015 | Dueck et al. | |
| 2014/0020976 | A1 * | 1/2014 | Shults | F41A 21/30 181/223 |
| 2014/0224574 | A1 * | 8/2014 | Latka | F41A 21/30 181/223 |
| 2015/0001001 | A1 * | 1/2015 | Wilson | B23K 26/345 181/223 |
| 2015/0260472 | A1 * | 9/2015 | Smith | F41A 21/30 89/14.2 |

FOREIGN PATENT DOCUMENTS

| | | | | |
|---|---|---|---|---|
| WO | WO 2015016998 | A2 * | 2/2015 | F41A 21/30 |

* cited by examiner

*Primary Examiner* — Forrest M Phillips
(74) *Attorney, Agent, or Firm* — Grogan, Tuccillo & Vanderleeden, LLP

(57) ABSTRACT

A sound suppressor for a firearm includes a generally cylindrical housing having a proximal end and a distal end, a plurality of baffle elements removably and slidably received within the housing, the baffle elements defining a plurality of expansion chambers within the housing, and an end closure element received on the distal end of the housing.

21 Claims, 6 Drawing Sheets

SOUND SUPPRESSOR

CROSS-REFERENCE TO RELATED APPLICATIONS

This application claims the benefit of U.S. Provisional Application Ser. No. 62/001,320, filed on May 21, 2014, which is herein incorporated by reference in its entirety.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. M67854-11-C-6505 awarded by Marine Corps Systems Command (MARCOSYSCOM).

FIELD OF THE INVENTION

The present invention relates generally to firearms and, more particularly, to a sound suppressor for firearms.

BACKGROUND OF THE INVENTION

Reducing noise and flash from military and security personnel firearms (e.g., long guns and pistols) provides a significant tactical advantage in the field. For military personnel, reduced sound levels will also reduce associated hearing loss. Additionally, application of sound suppression to civilian firearms reduces the objectionable noise to area residents and when used for hunting, to other hunters. Suppressors do not "silence" the gunshot. Instead, they reduce the level of sound associated with the detonation of the propellant.

The blast characteristics of a gunshot include three core elements. The first two core elements are the precursor blast and the main blast set up by the expanding gases. The precursor blast consists mostly of air with a small amount of propellant, while the main blast consists of spherical pressure waves that quickly overtake the fired projectile. Both of these blasts are sources of low frequency noise that carry for long distances.

The third core element is a highly visible gas flash which follows the blasts. In general, flash phenomena occur in two ways. Ammunition propellant is typically fuel rich, leaving unburned powder in the exhaust gases. As these high-pressure exhaust gases leave the muzzle of the firearm, the flow immediately expands and a shock wave is formed. Typically, the expansion forms a small glowing cone immediately following the muzzle, then several diameters away a large disk like shock wave forms, known as the mach disk. In these two regions, temperature and pressure levels change almost instantly. These sudden energy changes cause the exhaust gases to radiate light, known as the primary and intermediate flash, respectively.

As the unburned powder travels through this mach disk, the sudden temperature spike, along with the presence of oxygen in the ambient air allow these gases to reignite, generating a significant amount of visual signature. This is known as secondary flash.

To minimize the flash and the percussive level, it is necessary to slow the gases exiting the muzzle. This, however, must be accomplished without degrading the accuracy of the firearm.

SUMMARY OF THE INVENTION

It is an object of the present invention to provide a sound suppressor for a firearm.

It is an object of the present invention to provide a sound suppressor for a firearm that achieves high levels of sound and flash reduction.

It is an object of the present invention to provide a sound suppressor for a firearm that has minimal or no detrimental effect on the accuracy of the fired projectile.

According to an embodiment of the present invention a sound suppressor for a firearm is provided. The sound suppressor includes a housing having a proximal end and a distal end, a first expansion chamber downstream from said proximal end, a first baffle element, a second baffle element and a second expansion chamber intermediate the first baffle element and the second baffle element. The first baffle element is positioned within the housing downstream from the first expansion chamber and has a plurality of annular shoulders that increase in diameter in a downstream direction, a body portion downstream from the annular shoulders and a central aperture configured to allow passage of a projectile therethrough. The second baffle element is positioned within the housing downstream from the first baffle element and has a plurality of annular shoulders that increase in diameter in a downstream direction, a plurality of slots formed in the annular shoulders, a body portion downstream from the annual shoulders and a central aperture configured to allow passage of the projectile therethrough. The slots provide a passageway from an upstream side of the second baffle element to a downstream side of the second baffle element.

According to another embodiment of the present invention, a sound suppressor for a firearm is provided. The sound suppressor includes a generally cylindrical housing having a proximal end and a distal end, a plurality of baffle elements removably and slidably received within the housing, the baffle elements defining a plurality of expansion chambers within the housing, and an end closure element received on the distal end of the housing.

According to yet another embodiment of the present invention, a method of assembling a sound suppressor is provided. The method includes the steps of inserting a series of baffle elements into a housing of the sound suppressor until a forward shoulder of a first baffle element in the series contacts a position stop formed in the housing adjacent to a proximal end of the housing, and connecting an end closure element to a distal end of the housing. The end closure element includes a retaining feature configured to contact a rear rim of a last baffle element in the series to retain the series of baffle elements in spaced alignment within the housing.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
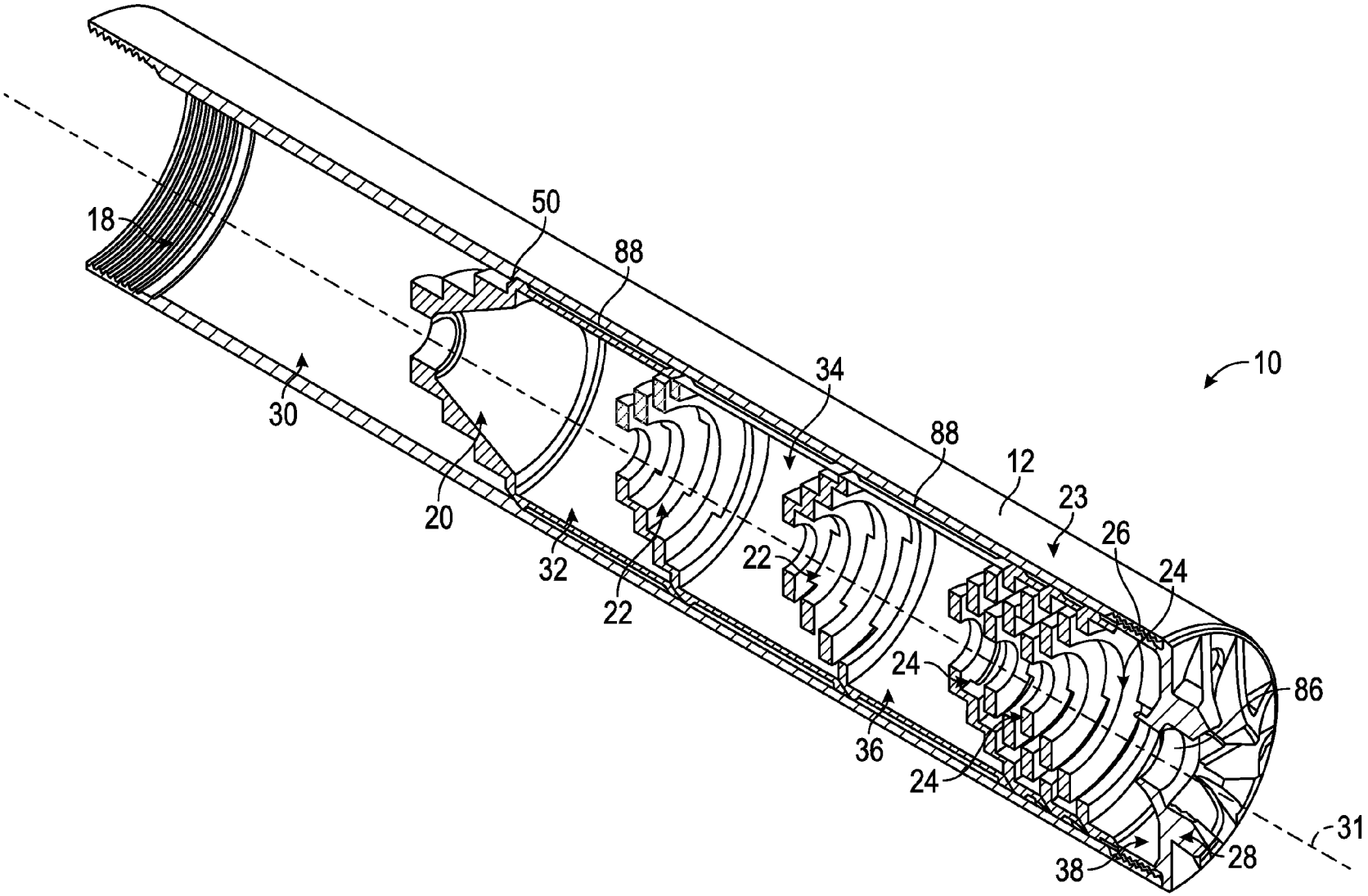
FIG. 1 is a cross-sectional, perspective view of a firearm sound suppressor in accordance with an embodiment of the present invention.
Figure 2:
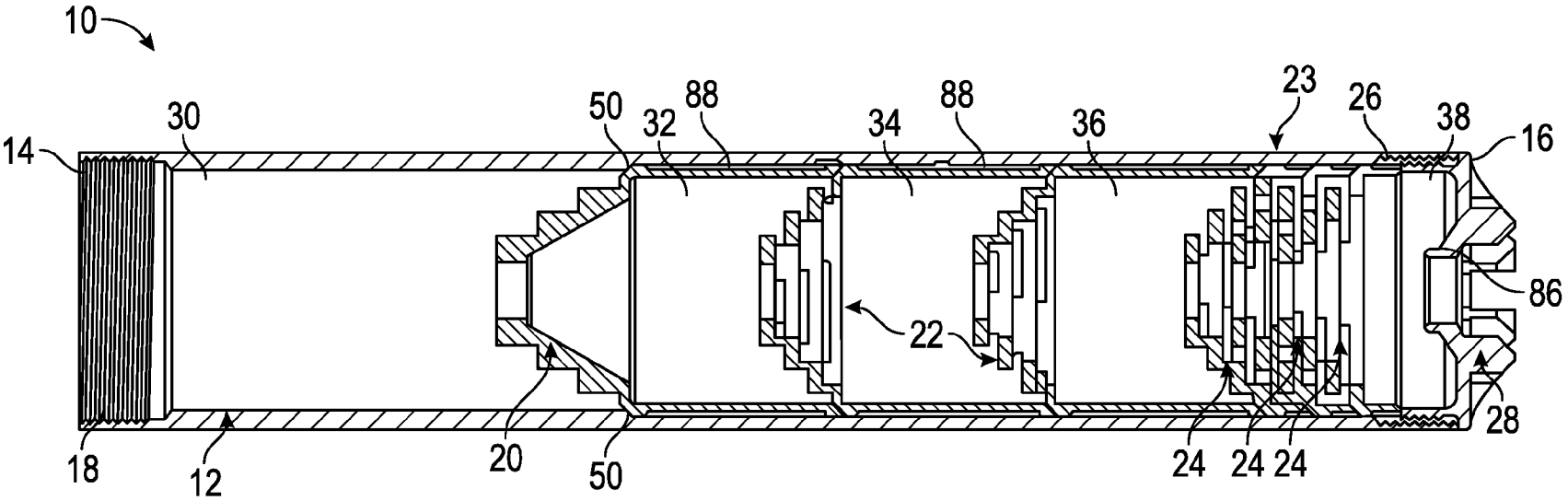
FIG. 2 is a side, cross-sectional view of the sound suppressor of FIG. 1.

With reference to FIGS. 1 and 2, a sound suppressor 10 according to an embodiment of the present invention is illustrated. As shown therein, the suppressor 10 includes a hollow cylindrical housing 12 having a proximal end 14 and a distal end 16. The proximal end 14 includes an internally threaded portion 18 configured to facilitate attachment of the suppressor 10 to a firearm (not shown). In particular, the threaded portion 18 is configured to threadably engage corresponding external threads on the muzzle end of a firearm (not show), or external threads on an adapter device or a muzzle device, such as a flash suppressor. In an embodiment, the housing 12 has a substantially constant diameter from the proximal end 14 to the distal end 16. The suppressor 10 also includes a series of generally conically-shaped, stepped baffles arranged within the housing 12, including a solid stepped baffle 20, a pair of long-slotted stepped baffles 22, and a nested stack 23 of three short-slotted stepped baffles 24. The baffles 20, 22 and 24 define first, second, third and fourth baffle stages, respectively. As further shown therein, the distal end 16 includes a second internally threaded portion 26 allowing for the threaded attachment of an end closure element 28.

As best shown in FIG. 2, the positioning of the baffles 20, 22, 24 within the housing defines a plurality of expansion chambers, including a first expansion chamber 30 between the proximal end 14 and the solid baffle 20, a second expansion chamber 32 between the solid baffle 20 and the first long-slotted baffle 22, a third expansion chamber 34 between the pair of long-slotted baffles 22, a fourth expansion chamber 36 between the second long-slotted baffle 22 and the first short-slotted baffle 24 of the nested stack 23 of three short-slotted baffles 24, and a fifth expansion chamber 38 between the third short-slotted baffle 24 in the stack 23 and the end closure element 28. The housing 12 defines a longitudinal axis 31 of the suppressor 10, as best illustrated in FIG. 1. While the preferred embodiment is shown as having a nested stack 23 of three short-slotted stepped baffles 24, the nested stack 23 may include more or fewer than three baffles 24 without departing from the broader aspects of the present invention.

Figure 3:
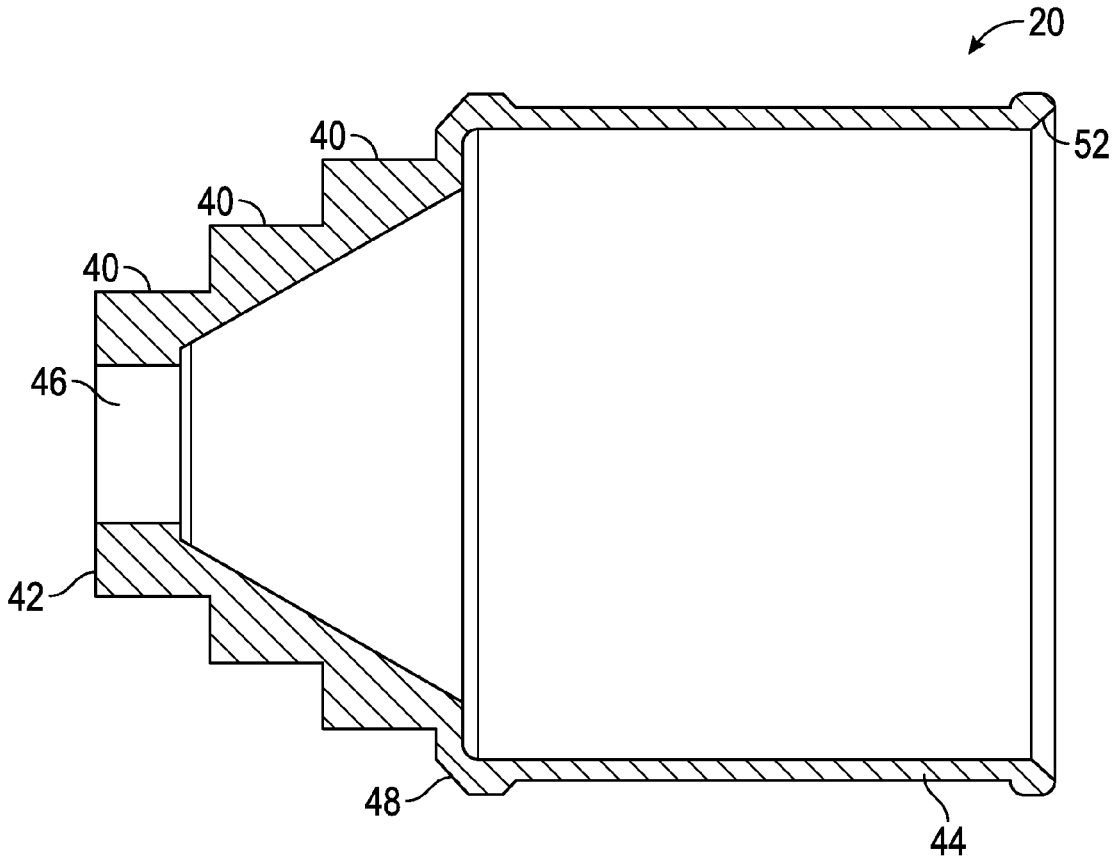
FIG. 3 is a side, cross-sectional view of a first blast baffle of the sound suppressor of FIG. 1.
Figure 4:
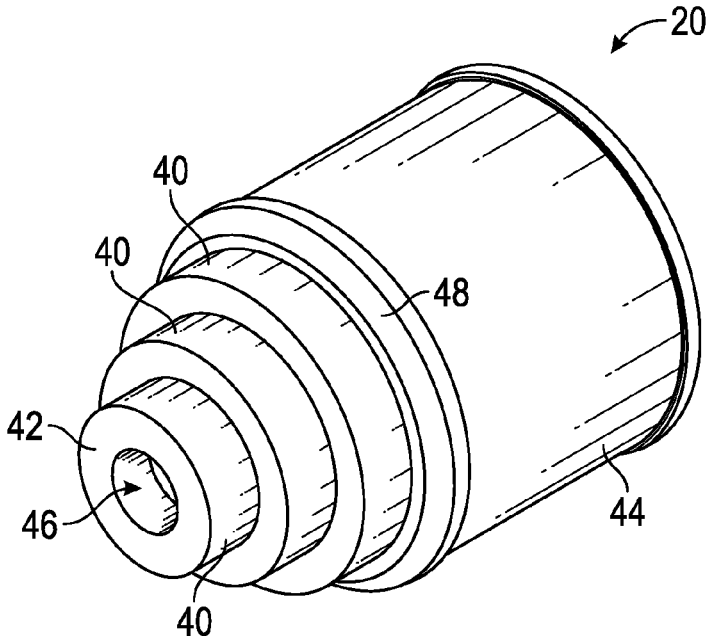
FIG. 4 is a perspective view of the first blast baffle of FIG. 3.

Turning now to FIGS. 3 and 4, detail views of the solid stepped baffle 20 are shown. The solid stepped baffle 20 includes a plurality of cylindrical, concentric steps or annular shoulders 40 on the exterior surface of the baffle that progressively increase in external diameter from an apex 42 of the baffle 20 to a cylindrical body portion 44. The baffle 20 includes a bore aperture 46 that allows for the passage of a projectile through the baffle 20, as discussed hereinafter. Importantly, the baffle 20 includes a forward annular shoulder 48 that is configured to contact an annular position stop 50 inside the housing 12. In particular, when inserted from the distal end 16, the baffle 20 slides axially into the housing towards the proximal end 14 until the annular shoulder 48 of the baffle 20 contacts the position stop 50 within the housing 12. The location of the position stop 50, therefore, limits further travel of the baffle 20 and establishes the size of the first expansion chamber 30. As best shown in FIG. 3, the distal end of the body portion 44 is also formed with an annular rim 52 that is configured to contact the next baffle 22 in the series to define the size of the second expansion chamber 32, as discussed in detail hereinafter.

Figure 5:
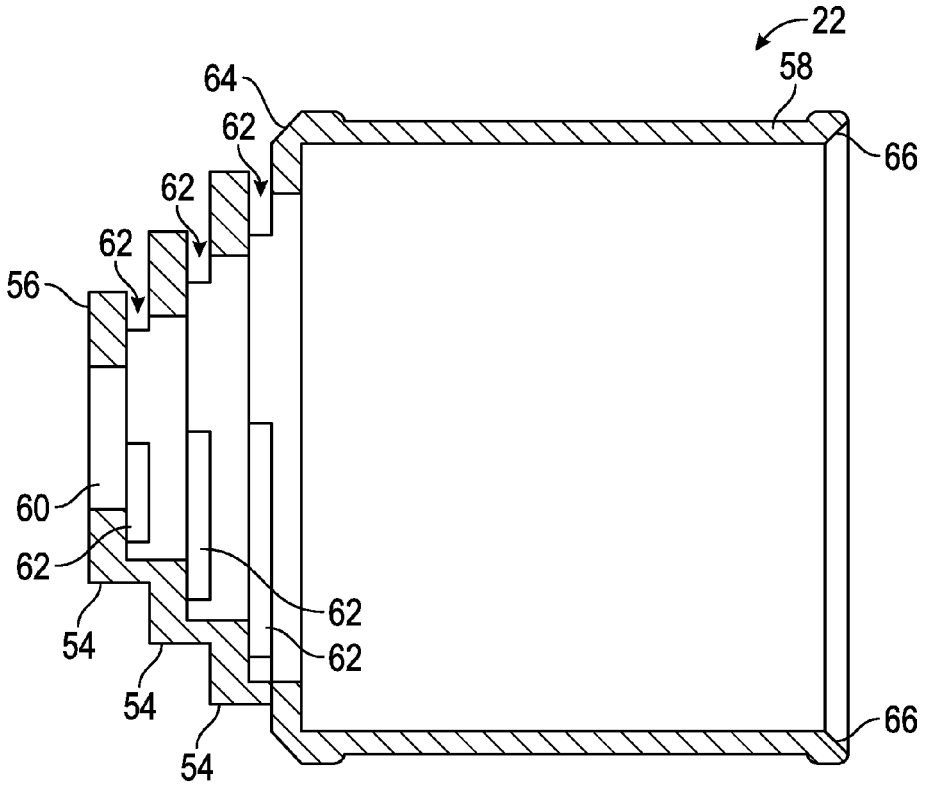
FIG. 5 is a side, cross-sectional view of a long slotted blast baffle of the sound suppressor of FIG. 1.
Figure 6:
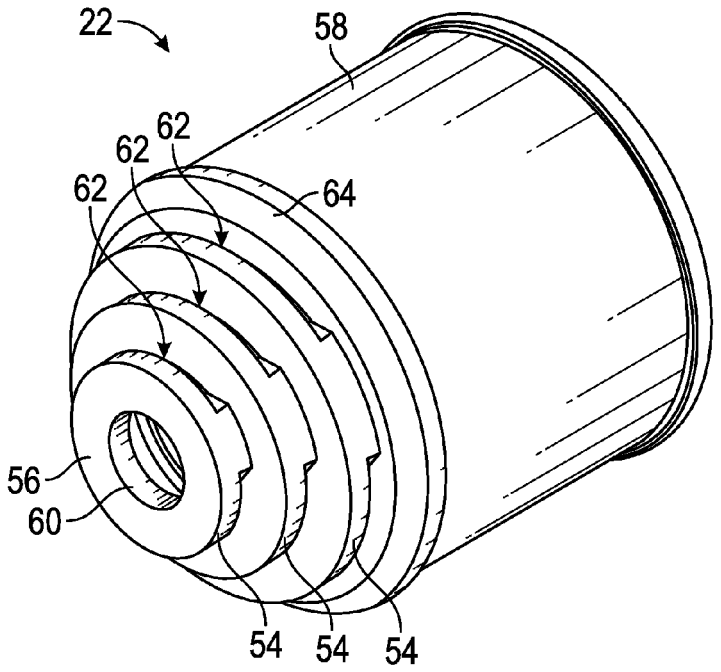
FIG. 6 is a perspective view of the long slotted blast baffle of FIG. 5.

With reference to FIGS. 5 and 6, the long-slotted baffles 22 are generally similar in configuration to the solid baffle 20. As shown, the long-slotted baffles 22 include a plurality of cylindrical, concentric steps or annular shoulders 54 on the exterior surface of the baffle that progressively increase in external diameter from an apex 56 of the baffle 22 to a cylindrical body portion 58. The baffles 22 include a bore aperture 60 that allows for the passage of a projectile through the baffle 22. Importantly, the annular shoulders 54 each include a trio of radial slots 62 extending therethrough and positioned at 0, 120 and 240 degrees, which provide for fluid communication between the exterior of the baffle 22 and the interior thereof, the function of which will be discussed hereinafter. Importantly, the baffles 22, like solid baffle 20, include a forward annular shoulder 64 that is configured to contact the annular rim of the baffle immediately preceding it, and an annular rim 66 at the distal end of the body portion 58. When the first baffle 22 of the pair is inserted from the distal end 16, the baffle 22 slides axially into the housing 12 towards the proximal end 14 until the annular shoulder 64 of this baffle 22 contacts the annular rim 52 of the solid baffle 20. This limits further travel of the baffle 22 and establishes the size of the second expansion chamber 32. Likewise, when the second baffle 22 of the pair is inserted from the distal end, the baffle 22 slides axially into the housing 12 towards the proximal end 14 until the annular shoulder 64 of this baffle 22 abuts the annular rim 66 of the first baffle 22 immediately preceding it. This limits further travel of the second baffle 22 and establishes the size of the third expansion chamber 34.

Figure 7:
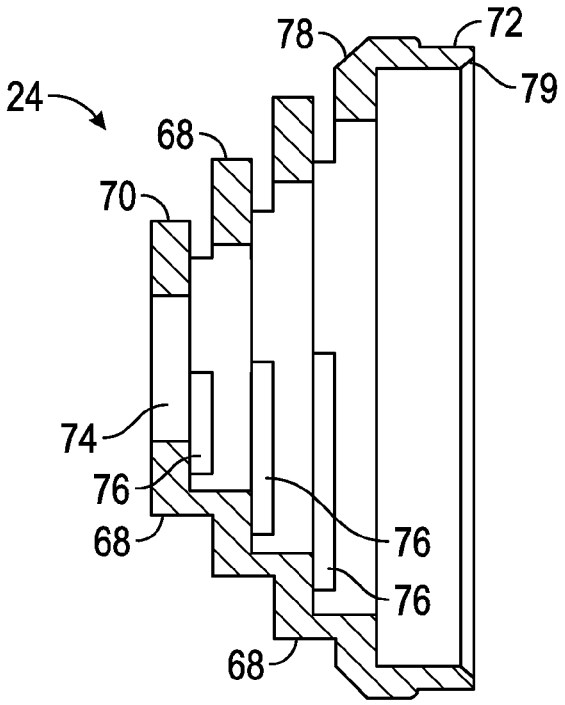
FIG. 7 is a side, cross-sectional view of a short slotted blast baffle of the sound suppressor of FIG. 1.
Figure 8:
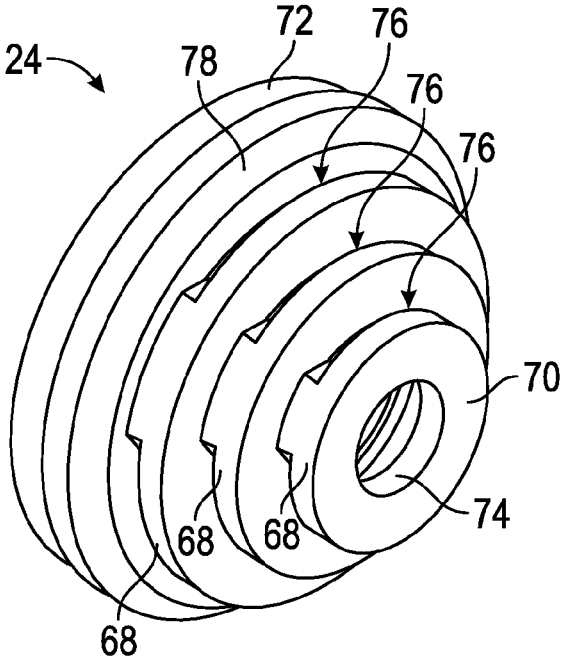
FIG. 8 is a perspective view of the short slotted blast baffle of FIG. 7.

As illustrated in FIGS. 7 and 8, the short-slotted baffle 24 is generally similar in configuration to the solid baffle 20 and long-slotted baffles 22 and includes a plurality of cylindrical, concentric steps or annular shoulders 68 on the exterior surface of the baffle that progressively increase in external diameter from an apex 70 of the baffle 24 to a cylindrical body portion 72. The baffle 24 includes a bore aperture 74 that allows for the passage of a projectile through the baffle 24. Importantly, the annular shoulders 68 each include a trio of radial slots 76 extending therethrough and positioned at 0, 120 and 240 degrees, which provide for fluid communication between the exterior of the baffle 24 and the interior thereof, the function of which will be discussed hereinafter. In the preferred embodiment, the slots 76 of the short-slotted baffle 24 are dimensionally equivalent to the slots 62 in the long-slotted baffles 22. The baffle 24 also includes a forward annular shoulder 78 that is configured to contact the annular rim 66 of the baffle 22 immediately preceding it. When the first baffle 24 of the stack 23 is inserted from the distal end 16, the baffle 24 slides axially into the housing 12 towards the proximal end 14 until the annular shoulder 78 of the baffle 24 contacts the annular rim 66 of the long-slotted baffle 22 in front of it. This limits further travel of the baffle 24 and establishes the size of the fourth expansion chamber 36. The remaining short baffles 24 may then be inserted into the housing 12 such that the annular shoulder 78 of each such baffle 24 contacts the annular rim 79 of the baffle 24 immediately in front of it, in a manner similar to that described above. It is this contact between the annular shoulder of each baffle and the annular rim of the baffle immediately before it within the housing that sets the position of each following baffle.

As illustrated, the body portion 72 of each short-slotted baffle 24 is substantially shorter in length than the body portion of the baffles 20, 22 (thus such baffles 24 are referred to as shot-slotted baffles 24 as opposed to long-slotted baffles 22 which are longer in longitudinal length).

Figure 9:
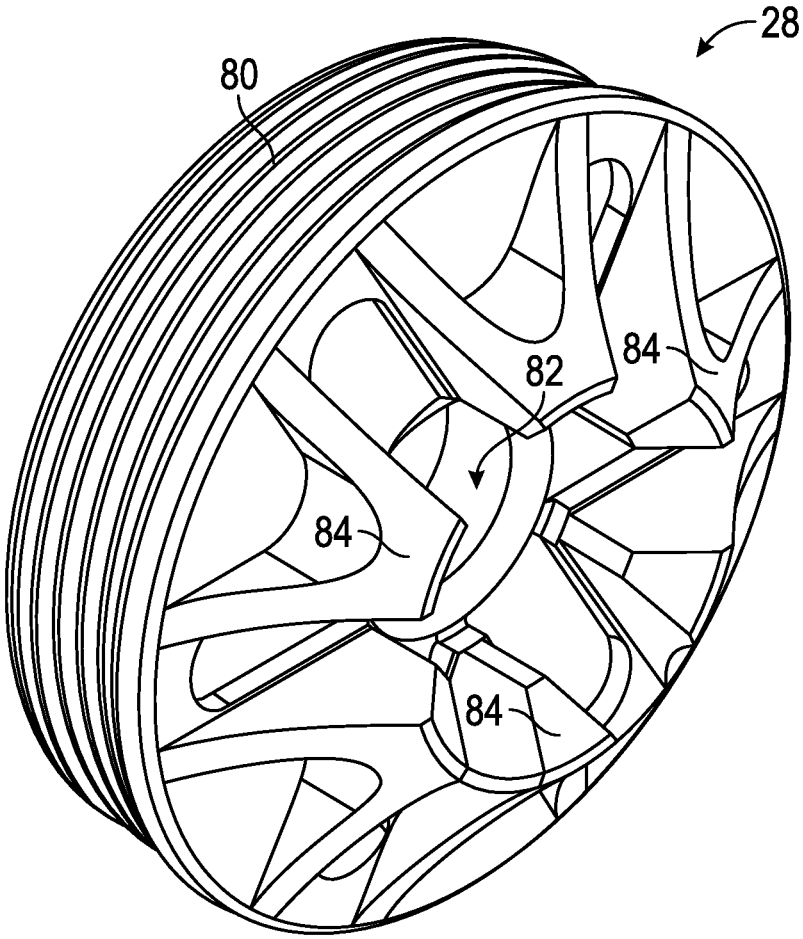
FIG. 9 is a detail, perspective view of an end closure of the sound suppressor of FIG. 1.

Turning now to FIG. 9, the end closure element 28 is generally in the shape of a disk and has a male threaded portion 80 configured to mate with the internally threaded portion 26 on the distal end 16 of the housing 12. The end closure element 28 also includes a throughbore 82 to allow for the passage of the projectile therethrough. In an embodiment, castellations 84 may be formed on the outer surface of the element 28. As best illustrated in FIGS. 1 and 2, the end closure element also includes a slightly conical protrusion 86 that extends into the flow stream, the function of which will be discussed hereinafter. Notably, the end closure element 28 is configured to contact the annular rim on the downstream end of the baffle 24 to retain the baffle 24 in position and serve as a final position stop to retain the array of baffles in position within the housing 12.

While the baffles 20, 22, 24 are shown in the preferred embodiment as having three steps or shoulders, in certain embodiments there may be more than three steps or fewer than three steps. Moreover, while each step of the long-slotted baffle 22 and short-slotted baffle 24 is shown as having a trio of slots therein, each step may have more or fewer than three slots. For example, there may be more than three slots in each step. In an embodiment, there may be two to six separate slots in each step, wherein each slot is dimensionally equivalent and is spaced equidistant apart from the adjacent slots.

The suppressor 10 is assembled in the manner hereinbefore described. In particular, the baffles, 20, 22, 24 are inserted into the housing 12 in sequence, and the end closure element 28 is threaded onto the distal end 16 of the housing 12 to retain the baffles stages in position. The suppressor 10 may then be threaded onto the muzzle of a firearm or muzzle device when desired. After the firearm is discharged, the projectile exits the muzzle end of the firearm and passes through the proximal end 14 and into the first expansion chamber 30 within the suppressor 10, where the gases likewise flow forward and expand into the expansion chamber 30. Gases flow forward and outward, impinging upon the stepped surfaces of the annular shoulders 40 of the solid stepped baffle 20. The stepped shoulders 40 of increasing diameter provide a means of directing and deflecting gases away from the bore aperture 46 within the baffle 20, as well for creating turbulence within the expansion chamber 30. The turbulence caused within expansion chamber 30 by the annular shoulders, coupled with the expansion of gases in expansion chamber 30 causes the gases to take longer to exit gas expansion chamber 30.

In particular, baffle 20 separates the gas flow into a first portion that passes through bore aperture 46 and a second portion that is directed away from the aperture 46 to a blind corner adjacent to the interior wall of the housing 12. Importantly, the sharp edges of each step and the slots provide significant losses for the gas flow. This process is repeated within each successive expansion chamber 32, 34, 36, 38 until the gases exit the sound suppressor 10 with reduced velocity and pressure, coupled with a reduction in noise level. The surface area of each baffle stage also provides a large surface area for the cooling of the expanding gases, thus aiding in reducing the gas flow rate by the transfer of thermal energy from the gases to the baffle elements. Moreover, the solid nature of the first baffle 20 helps reduce the blast impact on the remaining slotted baffles 22, 24 downstream, increasing the durability and life of the other suppressor components.

In addition, once the gases pass from the first chamber 30 into the rest of the suppressor 10, the gas flow outside the projectile path centerline is slowed by passage through the multiple slots in the long and short slotted baffles 22, 24, respectively. This slowed flow rejoins the main exit flow at the closure element 28 at a point in time significantly later than the initial primary blast wave to allow expansion with reduced percussive noise, which results in lower perceived noise exiting the suppressor 10. Indeed, the slots in the baffles 22, 24 permit exhaust gases to flow from the upstream side of the baffle to the downstream side of the baffle, i.e., from the outer surface to the inner surface.

In addition to the baffle stages, the end closure element 28 also contributes to noise reduction. In particular, the conical protrusion 86 of the end closure element 28 forces the expanding gases within the fifth expansion chamber 38 to reverse direction prior to exiting the suppressor through exit aperture 82. As the gases exit the suppressor, the castellations 84 help to diffuse the gases, which helps to reduce muzzle flash. The castellations 84 also provide grip for breaching. Additionally, should a user need to cut through rebar or other material, the slots between the castellations 84 are arranged in a manner that would allow the user to center the muzzle on the rebar.

In addition to the above described advantages in terms of achieving noise reduction and flash suppression, the ability to remove the end closure element 28 and the baffle elements therein provide for quick and easy disassembly and cleaning. This is in contrast to existing designs which do not allow for easy cleaning, which may result in the fouling of components and sub-optimal operation. Alternatively, however, the suppressor and baffle elements may be integrally formed for situations where fewer separate components may be desired.

In an embodiment, the annular shoulder and rear rim of each baffle 20, 22, 24 (protruding outwardly from the body portion) provide an integral spacer mechanism that create a small gap between the body of each baffle and the interior surface of the housing 12. This gap is best illustrated by reference numeral 88 in FIG. 2. This spacing or insulated air gap 88 allows for additional cooling of the suppressor 10 and insulation of the outer portion of the housing 12 from the heat generated during the ignition of the round of ammunition.

As used herein, the terms "inlet" and "outlet" are relative to an object passing through them with respect to a given structure, e.g. a bullet enters through the inlet into the suppressor housing and exits through the outlet out of the structure. The terms "upstream" and "downstream" are relative to the direction in which an object passes through/past various components, i.e. the object passes through an upstream component prior to passing through the downstream component.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A sound suppressor for a firearm, comprising:

a housing having a proximal end and a distal end;

a first expansion chamber downstream from said proximal end;

a first baffle element positioned within said housing downstream from said first expansion chamber, said first baffle element having a plurality of annular shoulders that increase in diameter in a downstream direction, a body portion downstream from said annular shoulders and a central aperture configured to allow passage of a projectile therethrough;

a second baffle element positioned within said housing downstream from said first baffle element, said second baffle element having a plurality of annular shoulders that increase in diameter in a downstream direction, a plurality of slots formed in said annular shoulders, a body portion downstream from said annual shoulders and a central aperture configured to allow passage of said projectile therethrough, said slots providing a passageway from an upstream side of said second baffle element to a downstream side of said second baffle element; and a second expansion chamber intermediate said first baffle element and said second baffle element;

wherein said first baffle is devoid of any slots other than said central aperture and is configured to separate a flow of gas into a first portion that passes through said central aperture and a second portion that is directed away from said central aperture.

2. The sound suppressor of claim 1, further comprising:

a third baffle element positioned within said housing downstream from said second baffle element, said third baffle element being substantially identical in configuration to said second baffle element;

wherein said second baffle element and said third baffle element define a third expansion chamber therebetween.

3. The sound suppressor of claim 2, further comprising:

a fourth baffle element positioned within said housing downstream from said third baffle element, said fourth baffle element having a plurality of annular shoulders that increase in diameter in a downstream direction, a plurality of slots formed in said annular shoulders, a body portion downstream from said annual shoulders and a central aperture configured to allow passage of said projectile therethrough, said slots providing a passageway from an upstream side of said fourth baffle element to a downstream side of said fourth baffle element;

wherein said fourth baffle element and said third baffle element define a fourth expansion chamber therebetween; and wherein said slots of said fourth baffle element are dimensionally longer than said slots of said third baffle element.

4. The sound suppressor of claim 3, further comprising:

a fifth baffle element positioned within said housing downstream from said fourth baffle element; and a sixth baffle element positioned within said housing downstream from said fifth baffle element;

wherein said fifth baffle element and said sixth baffle element are substantially identical to said fourth baffle element.

5. The sound suppressor of claim 4, further comprising:

an end closure element received on said distal end of said housing, said end closure element including a central aperture configured to allow passage of said projectile therethrough and a plurality of castellations formed on an outer surface of said end closure element surrounding said central aperture;

wherein said end closure element and said sixth baffle element define a fifth expansion chamber therebetween.

6. The sound suppressor of claim 5, wherein:

said end closure element includes a conical protrusion surrounding said central aperture, said conical protrusion extending from said end closure element into said fifth expansion chamber.

7. The sound suppressor of claim 1, further comprising:

a position stop formed on an internal sidewall of said housing, said position stop being configured to set an axial position of the first baffle within said housing.

8. The sound suppressor of claim 7, wherein:

said first baffle element includes a forward shoulder configured to contact said position stop.

9. The sound suppressor of claim 8, wherein:

said second baffle element includes a forward shoulder configured to contact a rear rim of said first baffle element; and wherein said rear rim of said first baffle element is configured to set said axial position of said second baffle element.

10. The sound suppressor of claim 9, wherein:

said fourth baffle element includes a forward shoulder configured to contact a rear rim of said third baffle element; and wherein said rear rim of said third baffle element is configured to set said axial position of said fourth baffle element.

11. The sound suppressor of claim 3, further comprising:

an annular insulating gap between said body portion of at least one of said baffle elements and an interior surface of said housing.

12. The sound suppressor of claim 11, wherein:

said housing is substantially cylindrical in shape and has a substantially uniform diameter from said proximal end to said distal end.

13. The sound suppressor of claim 12, wherein:

said baffle elements are removably and slidably received in said housing.

14. A sound suppressor for a firearm, comprising:

a generally cylindrical housing having a proximal end and a distal end;

a plurality of baffle elements removably and slidably received within said housing, said baffle elements defining a plurality of expansion chambers within said housing; and an end closure element received on said distal end of said housing;

wherein said plurality of baffle elements include at least a first baffle element that is generally conical in shape and has a plurality of concentric stepped portions that increase in diameter in a downstream direction, a generally cylindrical body portion downstream from said stepped portions, and a central bore configured to allow passage of a projectile through said first baffle element; and wherein said first baffle is devoid of any slots other than said central aperture and is configured to separate a flow of gas into a first portion that passes through said central aperture and a second portion that is directed away from said central aperture.

15. The sound suppressor of claim 14, wherein:

said housing includes a position stop formed on an inner surface thereof, said position stop being configured to set an axial position of at least one of said baffle elements within said housing.

16. The sound suppressor of claim 14, wherein:

said plurality of baffle elements include at least a first baffle element and a second baffle element;

wherein said second baffle element is generally conical in shape and has a plurality of concentric stepped portions that increase in diameter in a downstream direction, said stepped portions having a plurality of radial slots formed therein and providing passageways from an upstream end of said second baffle element to a downstream end of said second baffle element, a generally cylindrical body portion downstream from said stepped portions and a central bore configured to allow passage of said projectile through said second baffle element.

17. The sound suppressor of claim 16, wherein:

said plurality of baffle elements include a third baffle element, said third baffle element being generally conical in shape and having a plurality of concentric stepped portions that increase in diameter in a downstream direction, said stepped portions having a plurality of radial slots formed therein and providing passageways from an upstream end of said third baffle element to a downstream end of said third baffle element, a generally cylindrical body portion downstream from said stepped portions and a central bore configured to allow passage of said projectile through said third baffle element;

wherein said third baffle element is shorter in a longitudinal direction than said second baffle element.

18. The sound suppressor of claim 17, further comprising:

an annular insulating gap between said body portion of at least one of said baffle elements and an interior surface of said housing.

19. The sound suppressor of claim 18, wherein:

said end closure element includes a central aperture and a conical protrusion surrounding said central aperture and extending from said end closure element towards said baffle elements.

20. A method of assembling a sound suppressor, said method comprising the steps of:

inserting a series of baffle elements into a housing of said sound suppressor until a forward shoulder of a first baffle element in said series of baffle elements contacts a position stop formed in said housing adjacent to a proximal end of said housing, said first baffle element being devoid of any slots other than a central aperture for permitting passage of a projectile therethrough; and connecting an end closure element to a distal end of said housing, said end closure element including a retaining feature configured to contact a rear rim of a last baffle element in said series to retain said series of baffle elements in spaced alignment within said housing.

21. A method for suppressing sound in a firearm utilizing a sound suppressor, said method comprising the steps of:

providing a housing having a proximal end and a distal end;

forming a first expansion chamber downstream from said proximal end by positioning a first baffle element within said housing and spaced a first distance from said proximal end, said first baffle element including a central aperture and being devoid of any slots or passageways therethrough other than said central aperture;

forming a second expansion chamber downstream from said first baffle element by positioning a second baffle element within said housing and spaced a second distance from said proximal end, said second distance being greater than said first distance, said second battle element including a central aperture and at least one slot; and releasably securing said proximal end of said housing to a firearm.

* * * * *